US005662554A

United States Patent [19]

Schaefer

[11] Patent Number: 5,662,554

[45] Date of Patent: Sep. 2, 1997

[54] NECK EXERCISE DEVICE

[75] Inventor: Michael J. Schaefer, Richardson, Tex.

[73] Assignee: Schaefsco, Inc., Garland, Tex.

[21] Appl. No.: 354,549

[22] Filed: Dec. 13, 1994

[51] Int. Cl.[6] ..... A63B 23/03

[52] U.S. Cl. ..... 482/10; 119/833

[58] Field of Search ..... 482/10, 11, 24, 482/74; 54/7, 8; 119/702, 709, 833

[56] References Cited

U.S. PATENT DOCUMENTS

| | | | |
|---|---|---|---|
| 450,188 | 4/1891 | Peterson . | |
| 1,466,559 | 8/1923 | Purdy | 482/11 |
| 4,645,198 | 2/1987 | Levenston | 272/70.3 |
| 4,789,154 | 12/1988 | Mattox | 272/94 |
| 4,832,333 | 5/1989 | Lockett | 272/94 |
| 5,263,916 | 11/1993 | Bobich | 482/74 |
| 5,295,949 | 3/1994 | Hathaway | 602/18 |
| 5,336,139 | 8/1994 | Miller | 482/10 |

FOREIGN PATENT DOCUMENTS

| | | | |
|---|---|---|---|
| 0559138 | 9/1923 | France | 482/10 |

*Primary Examiner*—Stephen R. Crow
*Attorney, Agent, or Firm*—Martin Korn

[57] ABSTRACT

An exercise device for use in exercising the neck of a user includes a mouthpiece to be received by the mouth of a user and held in the user's mouth. The mouthpiece includes first and second sides. The device includes a first elastomeric band having first and second ends. The first end of the first elastomeric band is attached to the first side of the mouthpiece. A second elastomeric band includes first and second ends. The first end of the second elastomeric band is attached to the second side of the mouthpiece. The second ends of the first and second elastomeric bands are held in the hands of the user doing neck exercises.

6 Claims, 3 Drawing Sheets

NECK EXERCISE DEVICE

TECHNICAL FIELD OF THE INVENTION

The present invention relates to exercise devices, and more particularly to an exercise device for the rehabilitation, development, and ongoing wellness of muscles of the neck.

BACKGROUND OF THE INVENTION

The neck is one of the body's most flexible joints. Due to the mobility required of the neck, and the load the neck must carry, a complex arrangement of muscles, tendons, ligaments, and soft tissue are involved in supporting the head and absorbing shock in this area of the body. As part of the neck's normal daily function, neck movement includes rotation, flexion, extension, lateral bending, and combinations of all these movements. The neck muscles are easily strained if they are not sufficiently strong. Neck muscles are very susceptible to injury or other painful problems from a variety of sources, including jarring motion from motor vehicle accidents or contact sports; posture-related fatigue, and emotional stress.

When the head is suddenly jerked in one direction without warning, as in a motor vehicle accident, or in a contact sport, the neck muscles contract in spasm, which holds the muscle in a foreshortened position, and causes pain and interference with neck function and posture. When office workers sit for long hours at a desk or in front of a computer, they suffer neck fatigue due to improper posture, inactivity, and poor circulation; which can adversely affect a person's performance.

Furthermore, many people store emotional tension in the neck, which can result in headaches, sleeplessness, and even spasm when the tension does not get released.

There are common techniques employed in the rehabilitation of spasm and general muscle tension. Isometric contraction (where the force exerted by the muscle matches the resistance offered and movement does not occur), has been shown to induce a relaxation in the antagonist muscle group, and lessen the degree of spasm. Isotonic contraction (where the force exerted by the muscle overcomes resistance and movement does occur), has been shown to retrain weak muscles to normality, increase circulation, and in effect flush inflammation and tension from a muscle. Neither approach calls for heavy loading. In all cases the resistance is less than the muscle is capable of overcoming. Benefits accrue from light, repeated usage.

It is often difficult to consistently apply the light amounts of resistance needed for rehabilitation. Light resistance is generally not available in standard exercise equipment designed to build or bulk-up muscles.

A need has thus arisen for an exercise device for use on a daily basis to rehabilitate, develop, and strengthen the muscles of the neck and the surrounding area, affording the usage of both isometric and isotonic techniques; employing a safe, limited resistance.

A need has further arisen for an exercise device to allow neck injury sufferers to perform light exercise, either isometric or isotonic, especially with the injured muscle or its antagonist in isolation, to reduce spasm, relieve pain, and enable an injured patient to return to normal activities of daily living. As the injury heals, continued exercising, with slightly more resistance, employing complex movement, can be prescribed to strengthen the surrounding muscles, improve posture, and help prevent recurrence of injury.

A need has further arisen for a simple, portable, inexpensive, and safe device that can be prescribed for rehabilitation and ongoing general neck wellness.

SUMMARY OF THE INVENTION

An exercise device for use in exercising the neck of a user is provided. The device includes a mouthpiece to be received by the mouth of a user and held in the user's mouth. The mouthpiece includes first and second sides. The device includes a first elastomeric band having first and second ends. The first end of the first elastomeric band is attached to the first side of the mouthpiece. A second elastomeric band is provided and includes first and second ends. The first end of the second elastomeric band is attached to the second side of the mouthpiece. The second ends of the first and second elastomeric bands are held in the hands of the user doing neck exercises.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
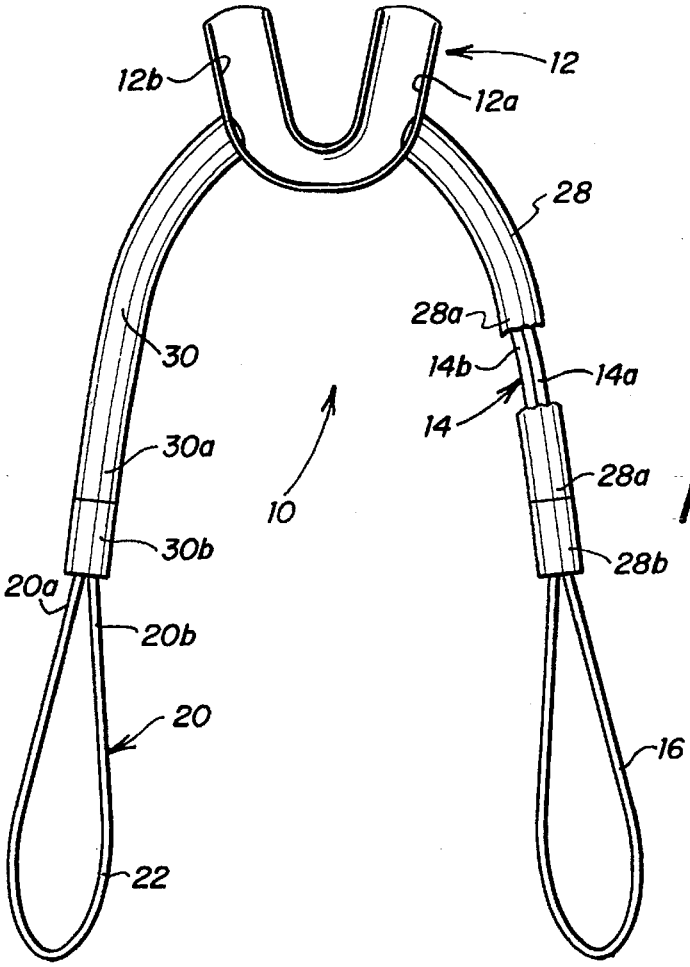
FIG. 1 is a plan view of the present neck exercise device.

Referring to FIG. 1, a plan view of the present neck exercise device is illustrated, and is generally identified by the numeral 10. Device 10 includes a mouthpiece, generally identified by the numeral 12. Mouthpiece 12 is similar to a sport's mouthpiece utilized by football players. Mouthpiece 12 may be molded with a unique shape to fit a specific individual's mouth, or of a generic shape in which the teeth of the user create an impression in the mouthpiece 12 in order to maintain mouthpiece 12 comfortably in the mouth of the user. Mouthpiece 12 includes side walls 12*a* and 12*b*.

Interconnected to side wall 12*a* of mouthpiece 12 is an elastomeric band 14. Elastomeric band 14 forms a continuous loop having members 14*a* and 14*b*. The ends of members 14*a* and 14*b* are attached to side wall 12*a* of mouthpiece 12. A loop 16 is formed in elastomeric band 14. Attached to side wall 12*b* of mouthpiece 12 is an elastomeric band 20 having members 20*a* and 20*b*. The ends of members 20*a* and 20*b* are interconnected to side wall 12*b*. Elastomeric member 20 includes a loop 22. Alternatively, a single elastomeric band 14 or 20 may be utilized with mouthpiece 12, with the end attached centrally between side walls 12*a* and 12*b*.

Loops 16 and 22 of elastomeric bands 14 and 20, respectively, are grasped in the hands of a user during neck exercises. Although a loop has been illustrated in FIG. 1 as having been formed by elastomeric bands 14 and 20, an additional loop may be interconnected to the ends of elastomeric bands 14 and 20 to form a separate loop of a different material. For example, a fabric, non-elastomeric, may be formed in a loop and tied to the end of elastomeric bands 14 and 20. Furthermore, although two members, 14*a* and 14*b* are illustrated as comprising elastomeric band 14, a single member may be utilized with the present invention.

Enclosing elastomeric band 14 is a sleeve 28. Sleeve 28 includes a section 28*a* and a section 28*b*. Enclosing elastomeric band 20 is a sleeve 30 having a section 30*a* and a section 30*b*. Sleeves 28 and 30 are comprised of, for example, a soft foam material.

In use of neck exercise device 10, mouthpiece 12 is placed within the mouth of the user, and is held in place by the teeth of the user without biting pressure. The hands of the user pass completely through loops 16 and 22. Sections 28*b* and 30*b* of sleeves 28 and 30, respectively, are held between the thumb and index finger of the user's hands. Additionally, loops 16 and 22 may be attached to a fixed structure when the user is incapable of grasping bands 14 and 20 with the user's hands or attaining the required position due to arm problems.

FIGS. 2 through 7 illustrate various exercises that can be performed utilizing the present invention.

All exercises using device 10 can be done from a standing or sitting position normally, or lying down when a specific muscle group needs to be isolated, or when the user is unable to maintain a standing or sitting position. In a sitting or standing position, the user starts by assuming correct posture. Looking straight ahead, tuck chin slightly and align ears, shoulders, and hips. When the head is moved in an exercise the user should try to look just a little bit farther in the direction of movement than the head will move. This helps increase the range of motion.

During exercise, all muscles not involved in the positioning or movement of the exercise should be relaxed. The user should move slowly and breathe normally during the exercises. Teeth should not be clenched, but there should be enough pressure with the teeth to hold the mouthpiece 12 in place. Before beginning the exercise, slack in bands 14 and 20 should be taken up by pulling on the loops 16 and 22.

As used here, Level 1 exercises are isometric exercises, where the force exerted by the neck muscles matches the resistance offered by the stretched bands 14 and 20, and head movement does not occur. The user's head is stationary and hand(s) apply tension as required.

Level 2 and 3 exercises are isotonic exercises, where the force exerted by the neck muscles overcomes resistance and head movement does occur. The user's hand(s) are stationary and the head moves.

Neither approach calls for heavy loading. The user benefits more by repetition than by increased resistance. The resistance applied should be less than the muscle is capable of overcoming. Resistance during an exercise can be varied if desired, by moving the hand(s) farther away from or closer to the face. The center position is referred to in each of the exercises as eyes forward and head straight.

Figure 2B:
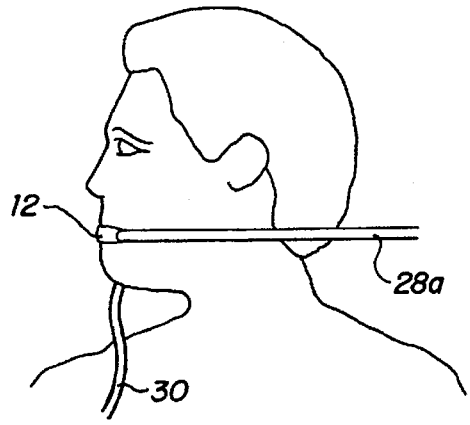
FIGS. 2*a* and 2*b* are pictorials illustrating use of the present invention for performing a rotation, side-to-side neck exercise.
Figure 2A:
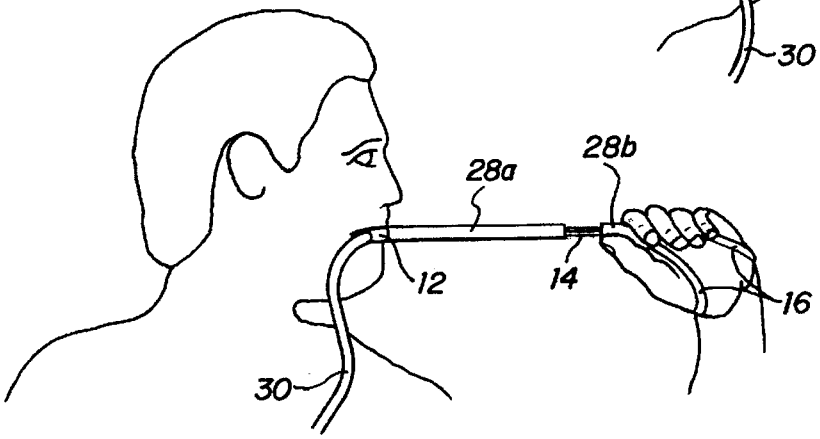

FIGS. 2*a* and 2*b* illustrate a rotation side-to-side exercise. The muscles involved are Longissimus capitis, Longus capitis, Longus colli, Obliquus capitis inferior, Rectus capitis anterior, Rectus capitis posterior major, Splenius capitis, Splenius cervicus, Multifidi, cervical; Rotatores, cervical; Scalenus anterior, Scalenus medius, Scalenus posterior, Semispinalis cervicis, Sternocleido mastoid, Trapezius, upper. In the starting position, one hand is raised level with the mouth as shown in FIG. 2*a*. The position of the head varies with each exercise.

LEVEL 1: Start with head in the center position and look straight ahead. Slowly apply tension by moving hand in a rearward direction alongside the head, while holding head in the center position.

LEVEL 2: From the center position, apply tension and slowly turn head as far as possible to the side opposite raised hand (FIG. 2*b*). Look a little farther in the direction of movement than head will move.

LEVEL 3: Turn head to the side until looking at raised hand (FIG. 2*a*). Apply tension and slowly turn head as far as possible to the side opposite raised hand. Look a little farther in the direction of movement than head will move. Repeat each exercise with the opposite hand.

Figure 3A:
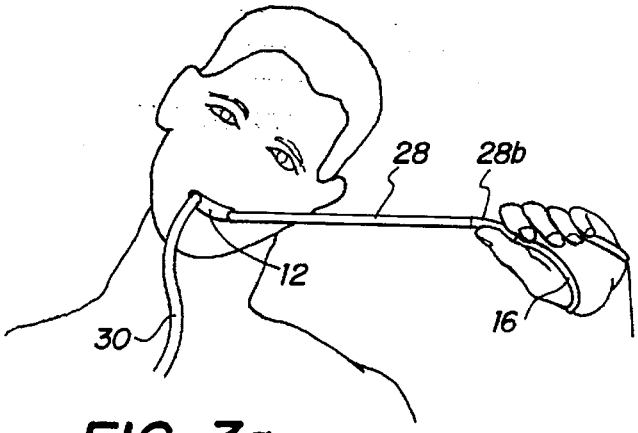
FIGS. 3*a* and 3*b* are pictorials illustrating use of the present invention for performing a lateral bending exercise.
Figure 3B:
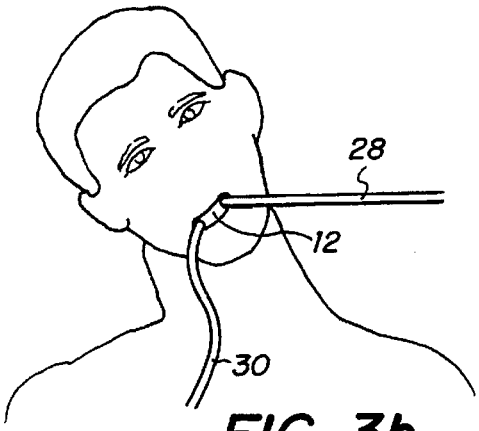

FIGS. 3*a* and 3*b* illustrate a lateral bending exercise. The muscles involved are Longus colli, Rectus capitis lateralis, Scalenus anterior, Scalenus medius, Scalenus posterior, Sternocleido mastoid, Obliquus capitis superior, Splenius cervicus, Splenius capitis, Trapezius, upper; Iliocostalis cervicis, Longissimus capitis, Intertransversarii, cervical. The starting position is with one hand raised level with the mouth as shown in FIG. 3*a*. The position of the head varies with each exercise.

LEVEL 1: Start with head in the center position and look straight ahead. Slowly apply tension by moving hand away from head while holding head in the center position.

LEVEL 2: From the center position, apply tension and slowly tilt head towards the opposite shoulder as far as possible (FIG. 3*a*), without turning the head. Keep eyes straight ahead throughout exercise.

LEVEL 3: Tilt head to the side as far as possible toward raised hand (FIG. 3*b*). Keep eyes straight ahead throughout exercise. Apply tension and slowly tilt head towards the opposite shoulder as far as possible, without turning head. These exercises are repeated with the opposite hand.

Figure 4A:
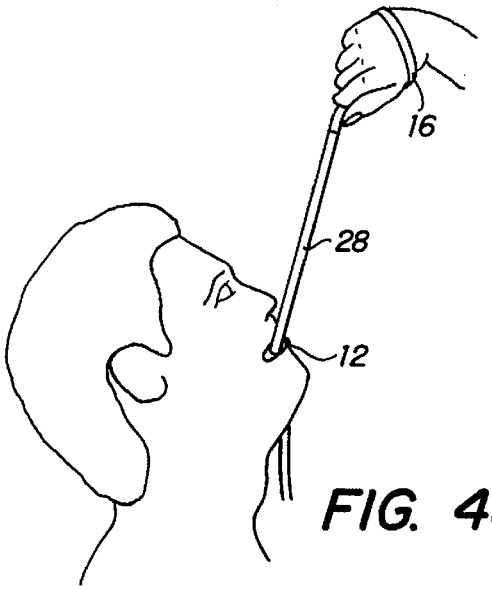
FIGS. 4*a* and 4*b* are pictorials illustrating use of the present invention for performing a flexion exercise.
Figure 4B:
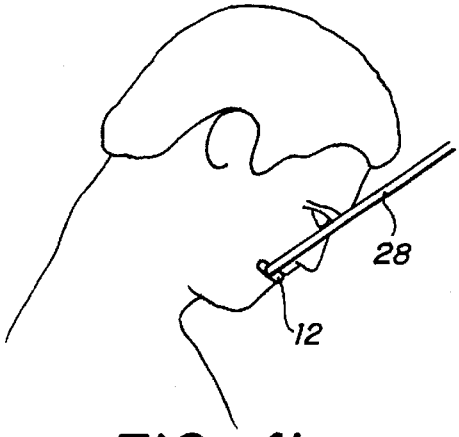

FIGS. 4*a* and 4*b* illustrate a flexion exercise. The muscles involved are Longus colli, Longus capitis, Rectus capitis anterior, Scalenus anterior, Platysma, Sternocleido mastoid. The starting position (FIG. 4*a*) is with both hands raised above the head as shown. The position of the head varies with each exercise.

LEVEL 1: Start with head in the center position and look straight ahead. Slowly apply tension by moving hands upward while holding head in the center position.

LEVEL 2: From the center position, apply tension and slowly move head downward until chin nearly touches the chest (FIG. 4*b*). Look a little farther in the direction of movement than head will move. Return to starting position.

LEVEL 3: Tilt head back as far as possible and look in that direction (FIG. 4*a*). Apply tension and slowly move head downward until chin nearly touches the chest. Look a little farther in the direction of movement than head will move.

Figure 5A:
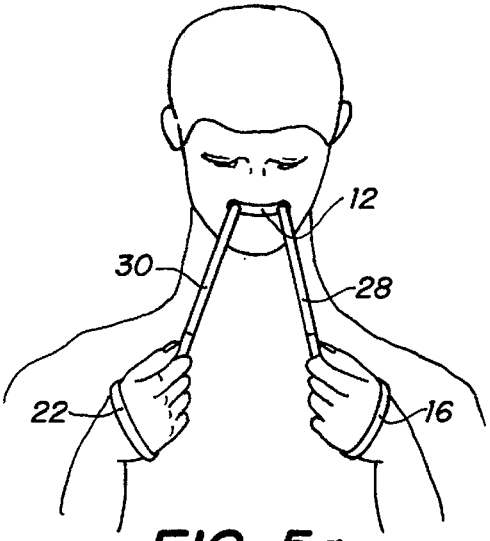
FIGS. 5*a*, 5*b* and 5*c* are pictorials illustrating use of the present invention for performing an extension exercise.
Figure 5B:
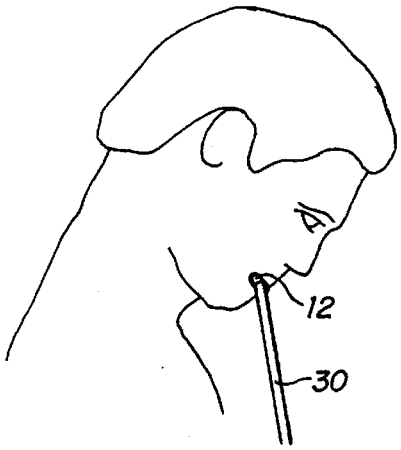
Figure 5C:
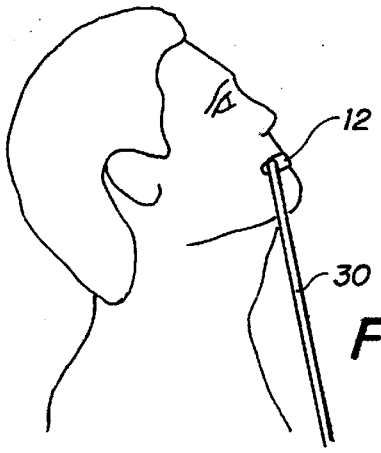

FIGS. 5*a*, 5*b* and 5*c* illustrate an extension exercise. The muscles involved are Sternocleido mastoid, Rectus capitis posterior minor, Rectus capitis posterior major, Obliquus capttis superior, Splenius cervicus, Splenius capitis, Trapezius, upper; Iliocostalis cervicis, Longissimus cervicis, Longissimus capitis, Spinalis cervicis, Spinalis capitus, Semispinalis cervicis, Semispinalis capitus, Multifidi, cervical; Rotatores, cervical; Interspinales, cervical. The starting position (FIG. 5*a*) is with both hands held at chest level as shown. The position of the head varies with each exercise.

LEVEL 1: Start with head in the center position and look straight ahead. Slowly apply tension by moving hands downward while holding head in the center position.

LEVEL 2: From the Center Position, apply tension and slowly move head back as far as possible. Look a little farther in the direction of movement than head will move.

LEVEL 3: Tilt head downward until chin nearly touches the chest (FIG. 5*b*). Look at the center of chest, apply tension, and slowly tilt head back as far as possible (FIG. 5*c*).

Figure 6A:
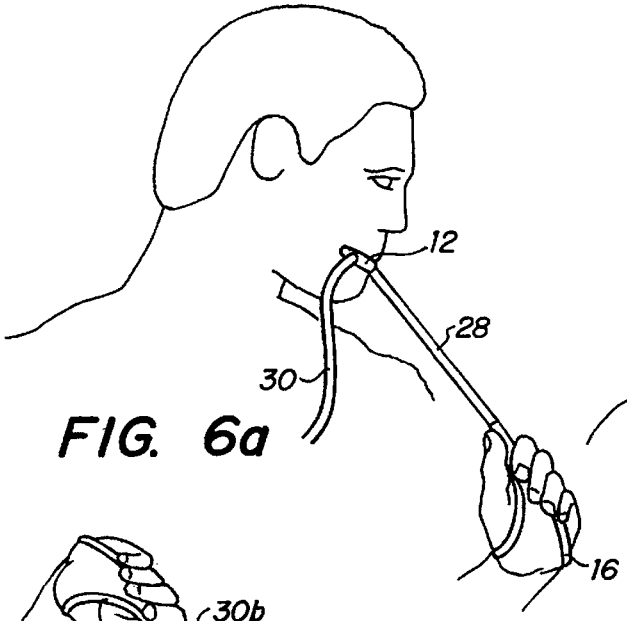
FIGS. 6*a* and 6*b* are pictorials illustrating use of the present invention for performing a rotation, low-to-high exercise.
Figure 6B:
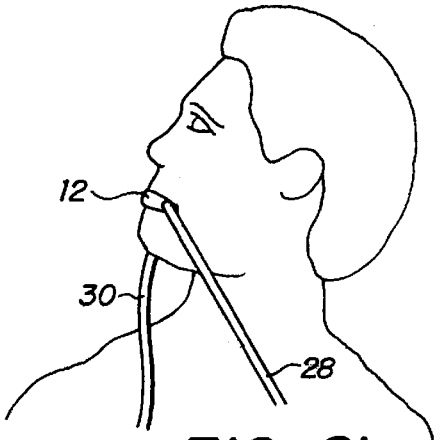

FIGS. 6*a* and 6*b* illustrate a rotation, low-to-high, exercise. This advanced exercise involves primarily rotation and extension. The muscles exercised correspond to those previously listed under Rotation and Extension. This exercise incorporates two basic movements in one exercise to simulate a complex movement of the head and neck. In the starting position, one hand is at chest level as shown in FIG. 6*a*. The position of the head varies with each exercise.

LEVEL 1: Start with head in the center position and look straight ahead. Slowly apply tension by moving hand in the direction away from head, while holding head in the center position.

LEVEL 2: From the center position, apply tension and slowly move head as far as possible up and away from hand (FIG. 6*b*). Look a little farther in the direction of movement than head will move.

LEVEL 3: Tilt head down and turn it to the side until looking at hand (FIG. 6*a*). Apply tension and slowly move head as far as possible up and away from hand. Look a little farther in the direction of movement than head will move. Repeat each of these exercises with the opposite hand.

Figure 7A:
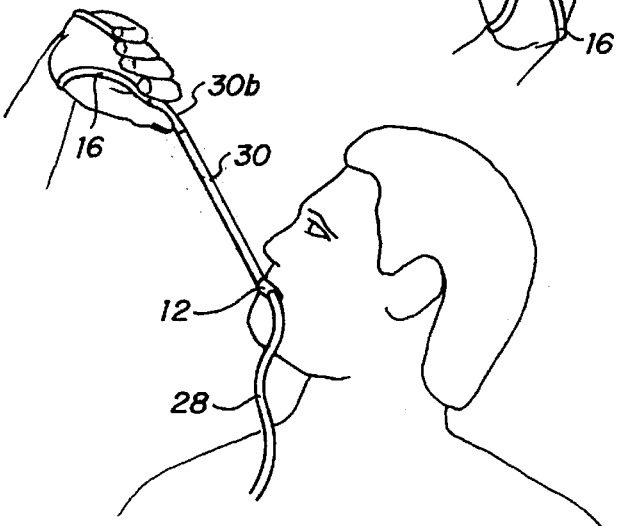
FIGS. 7*a* and 7*b* are pictorials illustrating use of the present invention for performing a rotation, high-to-low exercise.
Figure 7B:
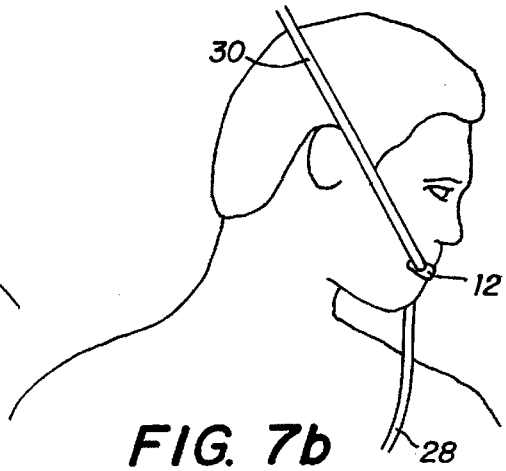

FIGS. 7*a* and 7*b* illustrate a high-to-low exercise. This advanced exercise involves rotation, lateral flexion, and unilateral flexion. The muscles exercised correspond to those previously listed under Rotation and Flexion. This exercise incorporates three basic movements in one exercise to simulate a complex movement of the head and neck. In the starting position, one hand is raised above the head as shown in FIG. 7*a*. The position of the head varies with each exercise.

LEVEL 1: Start with head in the center position and look straight ahead. Slowly apply tension by moving hand in the direction away from head, while holding head in the center position.

LEVEL 2: From the center position, apply tension and slowly move head as far as possible down and away from hand (FIG. 7*b*). Look a little farther in the direction of movement than head will move.

LEVEL 3: Tilt head up and turn it to the side until looking at raised hand (FIG. 7*a*). Apply tension and slowly move head as far as possible down and away from hand. Look a little farther in the direction of movement than head will move. Repeat each of these exercises with the opposite hand.

It therefore can be seen that the present neck exercise device allows a user to perform a variety of neck exercises, both isometric and isotonic, to recondition neck muscles strained in trauma, reduce muscle spasm of the neck to allow the head and neck to return to normal or better alignment, and to strengthen the supporting muscles in order to reinforce the alignment and to prevent reinjury. The present neck exercise device further provides for a wellness device to improve posture, reduce neck fatigue, and to improve circulation within the neck muscles. The present exercise device provides the user with a simple device to utilize which is both portable, small in size, and versatile to allow for a variety of exercises.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. An exercise device for use in exercising the neck of a user by performing rotation, lateral bending, flexion, or extension exercises, the device comprising:

a mouthpiece adapted to be received by the mouth of a user and held in the user's mouth;

a first elastomeric band having first and second ends, said first end thereof being attached to said mouthpiece;

a second elastomeric band having first and second ends, said first end thereof being attached to said mouthpiece; and said second ends of said first and second elastomeric bands being adapted to be grasped by the hands of a user to permit neck movement during neck exercise based upon positioning of the hands of the user.

2. The exercise device of claim 1 wherein said second ends of said first and second elastomeric bands include a grip to be grasped by the hands of a user during exercise.

3. The exercise device of claim 1 wherein said first and second elastomeric bands include a sleeve circumferentially disposed around said band.

4. An exercise device for use in exercising the neck of a user by performing rotation, lateral bending, flexion, or extension exercises, the device comprising:

a mouthpiece adapted to be received by the mouth of a user and held in the user's mouth, said mouthpiece having first and second sides;

a first elastomeric band having first and second ends, said first end thereof being attached to said first side of said mouthpiece;

a second elastomeric band having first and second ends, said first end thereof being attached to said second side of said mouthpiece; and said second ends of said first and second elastomeric bands being adapted to be grasped by the hands of a user to permit neck movement during neck exercise based upon positioning of the hands of the user.

5. The exercise device of claim 4 wherein said second ends of said first and second elastomeric bands include a grip to be grasped by the hands of a user during exercise.

6. The exercise device of claim 4 wherein said first and second elastomeric bands include a sleeve circumferentially disposed around said bands.

* * * * *